US009865913B2

(12) United States Patent
Kato et al.

(10) Patent No.: US 9,865,913 B2
(45) Date of Patent: Jan. 9, 2018

(54) COMMUNICATION TERMINAL AND CARD ANTENNA MODULE

(71) Applicant: Murata Manufacturing Co., Ltd., Nagaokakyo-shi, Kyoto-fu (JP)

(72) Inventors: Noboru Kato, Nagaokakyo (JP); Fumie Matsuda, Nagaokakyo (JP); Jun Sasaki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1067 days.

(21) Appl. No.: 13/660,156

(22) Filed: Oct. 25, 2012

(65) Prior Publication Data

US 2013/0050035 A1 Feb. 28, 2013

Related U.S. Application Data

(63) Continuation of application No. PCT/JP2011/055583, filed on Mar. 10, 2011.

(30) Foreign Application Priority Data

Apr. 26, 2010 (JP) ..... 2010-100953

(51) Int. Cl.
*H01Q 11/12* (2006.01)
*H01Q 1/24* (2006.01)
(Continued)

(52) U.S. Cl.
CPC ..... *H01Q 1/2225* (2013.01); *H01Q 1/243* (2013.01); *H01Q 1/52* (2013.01); *H01Q 7/00* (2013.01)

(58) Field of Classification Search
CPC ..... H01Q 1/243
See application file for complete search history.

(56) References Cited

U.S. PATENT DOCUMENTS 7,334,734 B2 * 2/2008 Hino ..... H01Q 1/22 235/487
2002/0096568 A1 7/2002 Arisawa
(Continued)

FOREIGN PATENT DOCUMENTS

CN 1256559 A 6/2000
CN 1874064 A 12/2006
(Continued)

OTHER PUBLICATIONS

Official Communication issued in corresponding Japanese Patent Application No. 2012-512713, dated Sep. 3, 2013.
(Continued)

*Primary Examiner* — Graham Smith
(74) *Attorney, Agent, or Firm* — Keating & Bennett, LLP

(57) ABSTRACT

A communication terminal in which a card antenna module is loaded into a terminal casing including an antenna is operated such that a degree of coupling between a terminal-casing-side antenna and a module-side antenna is minimized and that a module-side antenna has a desired frequency characteristic. The communication terminal includes a terminal casing including a terminal-casing-side antenna, and a card antenna module loaded into the terminal casing. The card antenna module includes a coupling coil which is disposed at a position close to the terminal-casing-side antenna and which is coupled with the terminal-casing-side antenna via a magnetic field, and a module-side antenna which is disposed at a position more distant from the terminal-casing-side antenna than the coupling coil.

20 Claims, 7 Drawing Sheets

(51) Int. Cl.

| | |
|---|---|
| ***H01Q 1/22*** | (2006.01) |
| ***H01Q 1/52*** | (2006.01) |
| ***H01Q 7/00*** | (2006.01) |

(56) References Cited

U.S. PATENT DOCUMENTS

| | | | | |
|---|---|---|---|---|
| 2006/0267853 | A1 | 11/2006 | Naito | |
| 2008/0081631 | A1* | 4/2008 | Rofougaran | 455/452.1 |
| 2009/0051606 | A1 | 2/2009 | Ochi et al. | |
| 2009/0160719 | A1* | 6/2009 | Kato | G06K 19/07749 343/742 |

FOREIGN PATENT DOCUMENTS

| | | | |
|---|---|---|---|
| JP | 63-012085 | A | 1/1988 |
| JP | 09-107228 | A | 4/1997 |
| JP | 2006-054772 | A | 2/2006 |
| WO | 2007/125948 | A1 | 11/2007 |

OTHER PUBLICATIONS

Official Communication issued in International Patent Application No. PCT/JP2011/055583, dated Jun. 14, 2011.

* cited by examiner

COMMUNICATION TERMINAL AND CARD ANTENNA MODULE

BACKGROUND OF THE INVENTION

1. Field of the Invention

The present invention relates to communication terminals and card antenna modules, and particularly to a card antenna module preferably for use in an RFID (Radio Frequency Identification) system and a communication terminal including the same.

2. Description of the Related Art

RFID systems serving as article management systems are known. In RFID systems, a reader/writer and an RFID tag communicate with each other in a non-contact manner, and information is transmitted between the reader/writer and the RFID tag.

Each of the reader/writer and the RFID tag includes an RFIC chip for processing radio signals and an antenna for transmitting and receiving radio signals. Certain information is transmitted and received between the antenna of the RFID tag and the antenna of the reader/writer via a magnetic field or an electromagnetic field.

In recent years, there have been some cases where an RFID system is introduced to a communication terminal such as a mobile phone, and the communication terminal is used as a reader/writer or an RFID tag. As a technique of giving an RFID function to a communication terminal, a technique of using a card antenna module is known, as described in, for example, Japanese Unexamined Patent Application Publication No. 2006-054772 and International Publication No. WO 2007/125948. With this technique, a card antenna module including an antenna and an RFIC chip is inserted into a casing of a communication terminal, and the communication terminal provided with the card antenna module is used as an RFID reader or an RFID tag.

In recent years, casings of communication terminals often include an antenna for an HF-band RFID system, such as FeliCa (registered trademark) and NFC (Near Field Communication). When a casing of a communication terminal includes an antenna for an HF band, particularly when a card antenna module includes an antenna for an HF-band RFID system, the module-side antenna and the terminal-casing-side antenna are coupled with each other via a magnetic field, and the module-side antenna may not operate properly.

In contrast, if a magnetic or metallic flat plate is attached to a card antenna module so that a terminal-casing-side antenna is shielded by the magnetic or metallic flat plate when the module is inserted into the terminal casing, coupling between the module-side antenna and the terminal-casing-side antenna can be reduced. However, if the terminal-casing-side antenna is not completely covered, coupling between the module-side antenna and the terminal-casing-side antenna occurs. Also, a magnetic flat plate or a metallic flat plate having a large area needs to be provided to completely cover the terminal-casing-side antenna. That is, the card antenna module is operated by inserting it into a slot of the terminal casing, but it is difficult to completely shield the terminal-casing-side antenna only by inserting the module into the slot.

SUMMARY OF THE INVENTION

In view of the above-described circumstances, preferred embodiments of the present invention provide a communication terminal capable of minimizing coupling between a terminal-casing-side antenna and a module-side antenna and obtaining a desired operation of the module-side antenna with a simple configuration, and a compact and thin card antenna module which is inserted into the communication terminal.

A communication terminal according to a preferred embodiment of the present invention is a communication terminal that includes a terminal casing including a terminal-casing-side antenna, and a card antenna module loaded into the terminal casing. The card antenna module includes a coupling resonator which is disposed at a position close to the terminal-casing-side antenna and which is coupled with the terminal-casing-side antenna, and a module-side antenna which is disposed at a position more distant from the terminal-casing-side antenna than the coupling resonator.

A card antenna module according to a preferred embodiment of the present invention is a card antenna module loaded into a terminal casing of a communication terminal including a terminal-casing-side antenna. The card antenna module includes a coupling resonator which is disposed at a position close to the terminal-casing-side antenna and which is capable of being coupled with the terminal-casing-side antenna, and a module-side antenna which is disposed at a position more distant from the terminal-casing-side antenna than the coupling resonator.

A card antenna module loaded into a communication terminal includes a coupling resonator which is coupled with a terminal-casing-side antenna, and thus coupling between the terminal-casing-side antenna and a module-side antenna can be minimized. Therefore, a communication terminal and a card antenna module that are compact and thin and that have a desired frequency characteristic can be realized.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a communication terminal and a card antenna module according to the present invention will be described on the basis of specific preferred embodiments.

First Preferred Embodiment

Figure 1:
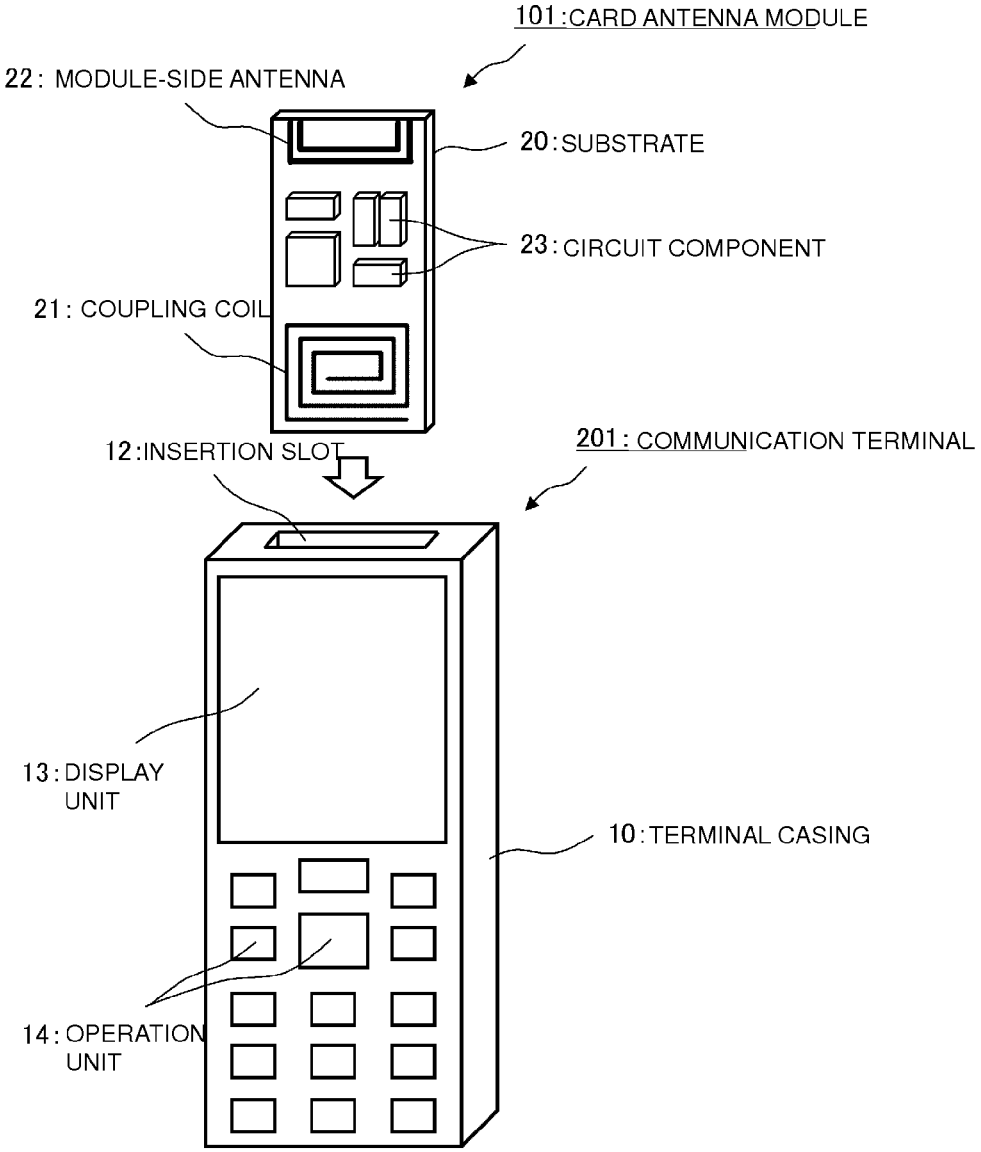
FIG. 1 is a perspective view of a card antenna module 101 and a communication terminal 201 according to a first preferred embodiment of the present invention.

FIG. 1 is a perspective view of a card antenna module 101 and a communication terminal 201 according to a first preferred embodiment of the present invention.

The communication terminal 201 includes a terminal casing 10 including a terminal-casing-side antenna for an HF band which is used in FeliCa, NFC, or the like, and the card antenna module 101 loaded into the terminal casing 10. The card antenna module 101 includes a module-side antenna 22 for an HF band, and is configured as a reader/writer module for constituting an HF-band RFID system, for example.

Figure 3:
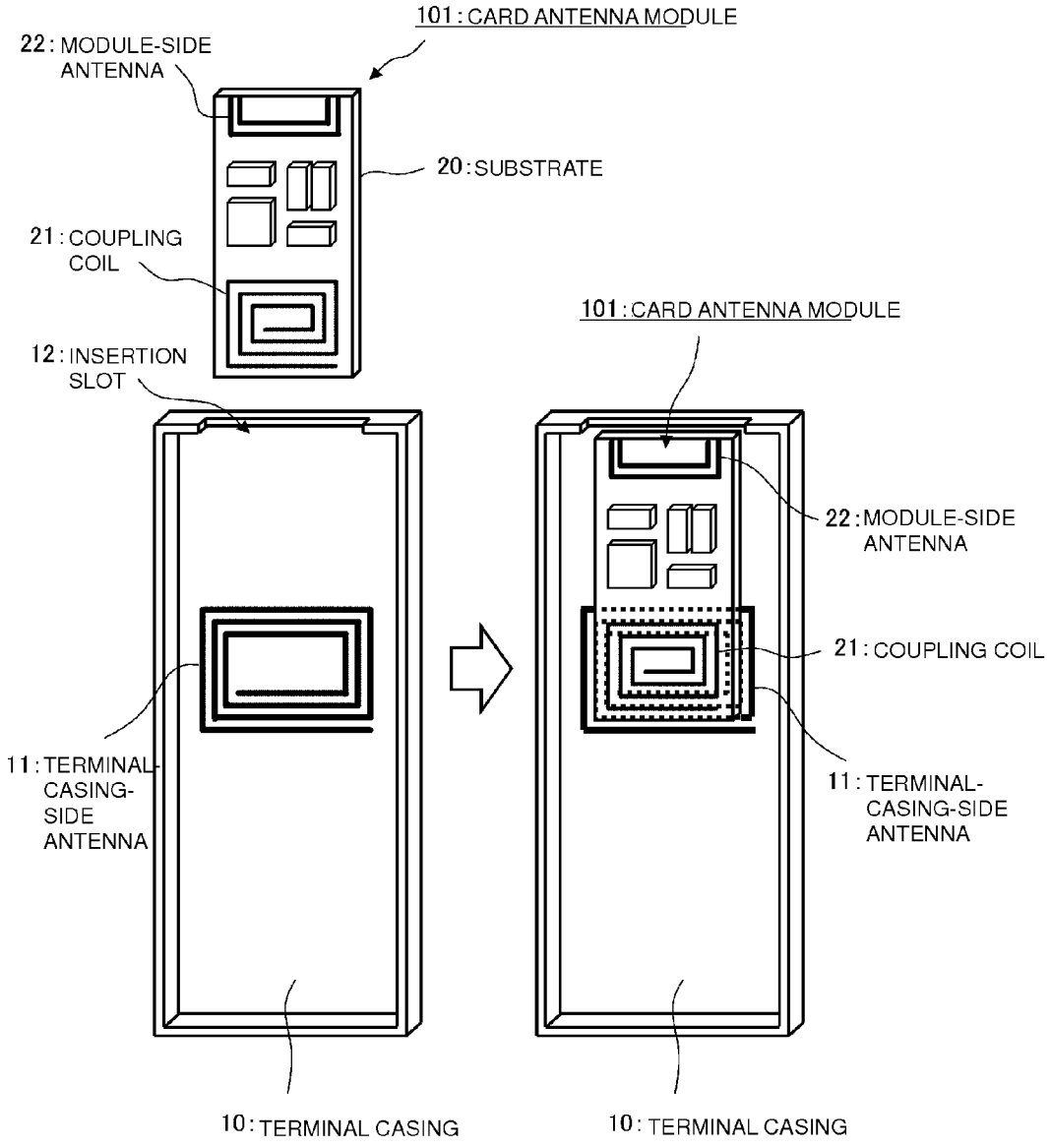
FIG. 3 is a perspective view illustrating a state where the card antenna module 101 is loaded into the communication terminal.

The communication terminal 201 is preferably configured as a mobile phone compatible with various types of communication systems of a UHF band, for example. As illustrated in FIG. 1, the communication terminal 201 includes a display unit 13 constituted by a liquid crystal display, an organic EL display, or the like, and an operation unit 14 used to input certain information, which are provided on one of principal surfaces of the terminal casing 10, and also includes, on an upper surface of the terminal casing 10, an insertion slot 12 through which the card antenna module 101 is to be loaded. The terminal-casing-side antenna for an HF band which is used in FeliCa, NFC, or the like is provided inside the terminal casing 10, as illustrated in FIG. 3. The terminal-casing-side antenna is configured by winding a metallic line into a coil shape, and is provided on an inner side of the terminal casing on the other principal surface side.

Figure 2A:
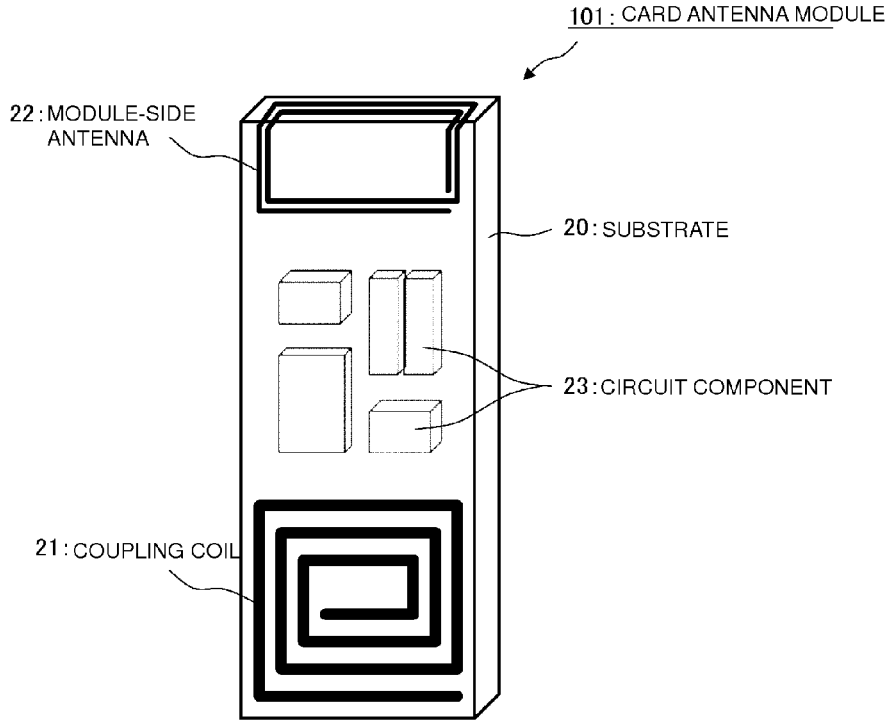
FIG. 2A is a perspective view of the card antenna module 101.
Figure 2B:
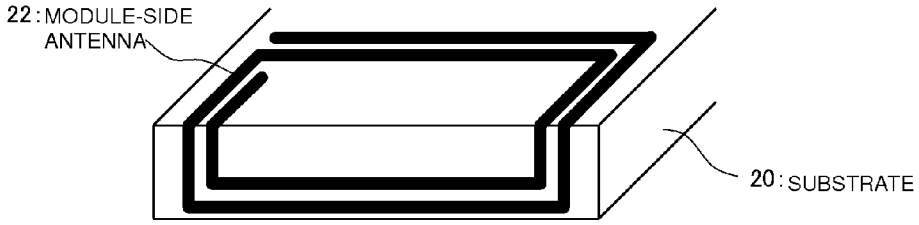
FIG. 2B is a perspective view of a module-side antenna 22.

FIG. 2A is a perspective view of the card antenna module 101, and FIG. 2B is a perspective view of the module-side antenna 22.

As illustrated in FIGS. 1, 2A and 2B, the card antenna module 101 includes the module-side antenna 22 which functions as an antenna for an HF-band reader/writer, circuit components 23 which are connected to the module-side antenna 22 and which have various functions to constitute a reader/writer, and a coupling coil 21 which functions as a coupling resonator. The module-side antenna 22 is provided at one end in the longitudinal direction of a substrate 20 of the card antenna module 101, and the coupling coil 21 is provided at the vicinity of the other end in the longitudinal direction of the substrate 20. The coupling coil 21 may be electrically independent of the other circuits or may be connected to a ground.

FIG. 3 is a perspective view illustrating a state where the card antenna module 101 is loaded into the communication terminal. FIG. 3 illustrates only a main portion necessary for description, with a front-surface side portion of the terminal casing 10 being removed.

As illustrated in FIGS. 1, 2A, 2B and 3, the module-side antenna 22 of the card antenna module 101 is provided on the substrate 20, at a distance from the terminal-casing-side antenna 11 when the card antenna module 101 is loaded into the terminal casing 10, more specifically, at a distance longer than the distance between the terminal-casing-side antenna 11 and the coupling coil 21.

As illustrated in FIG. 2B, the module-side antenna 22 is preferably configured by forming a multilayer coil pattern in a multilayer body including flexible sheet substrates which are stacked on each other. With its flexibility, the module-side antenna 22 is continuously pasted in a bent state on a principal surface and a side surface of the substrate 20 of the card antenna module 101.

The circuit components 23 of the card antenna module 101 include a semiconductor IC chip including a logic circuit and a memory circuit to process HF signals, and furthermore a passive component chip, such as a chip capacitor and a chip inductor to provide a matching circuit, a filter circuit, and so forth, and constitute various functional blocks that constitute an HF-band reader/writer.

The coupling coil 21 of the card antenna module 101 functions as a coupling resonator. The coupling coil 21 is disposed at a position close to the terminal-casing-side antenna 11 including a coil pattern when the card antenna module 101 is loaded into the terminal casing, more specifically, at a position facing the terminal-casing-side antenna 11, and is coupled to the terminal-casing-side antenna 11. The coupling coil 21 is preferably configured by forming a multilayer coil pattern in a multilayer body including flexible sheet substrates which are stacked on each other. A winding axis of the multilayer coil pattern is disposed so as to be perpendicular or substantially perpendicular to the principal surface of the substrate 20. The coupling coil 21 has an inductance component generated by the multilayer coil pattern and a capacitance component generated by capacitance between wires of individual patterns. The inductance component and the capacitance component constitute an LC resonator. The resonance frequency of the coupling coil 21 is almost equivalent to the resonance frequency of the terminal-casing-side antenna 11, so that the coupling coil 21 is coupled with the terminal-casing-side antenna 11 via a magnetic field.

In this preferred embodiment, the terminal-casing-side antenna 11 and the module-side antenna 22 are antennas which are used in almost the same frequency band. However, the card antenna module 101 includes the coupling coil 21 which is coupled with the terminal-casing-side antenna 11. Thus, in a state where the card antenna module 101 is loaded, the terminal-casing-side antenna 11 is coupled with the coupling coil 21. Since the resonance frequency of an element in this coupling state (hereinafter "coupling element") is significantly different from the resonance frequency of the module-side antenna 22, the coupling between the terminal-casing-side antenna 11 and the module-side antenna 22 can be minimized. Therefore, the communication terminal 201 including the card antenna module 101 which is compact and thin and which has a desired frequency characteristic can be realized.

The terminal-casing-side antenna 11 is, for example, an antenna of FeliCa (registered trademark). The card antenna module 101 is, for example, a module for an RFID reader/writer. The card antenna module 101 communicates with an RFID tag attached to an article to read data, and the communication terminal 201 transmits the read data about the RFID tag to a database of a management center or the like by using a communication function of a mobile phone, for example.

Second Preferred Embodiment

Figure 4A:
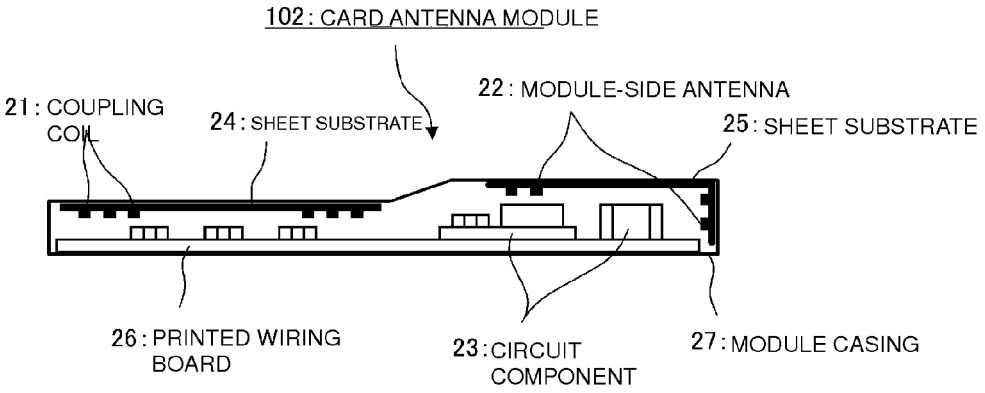
FIG. 4A is a diagram illustrating an internal structure of a card antenna module 102 according to a second preferred embodiment of the present invention.
Figure 4B:
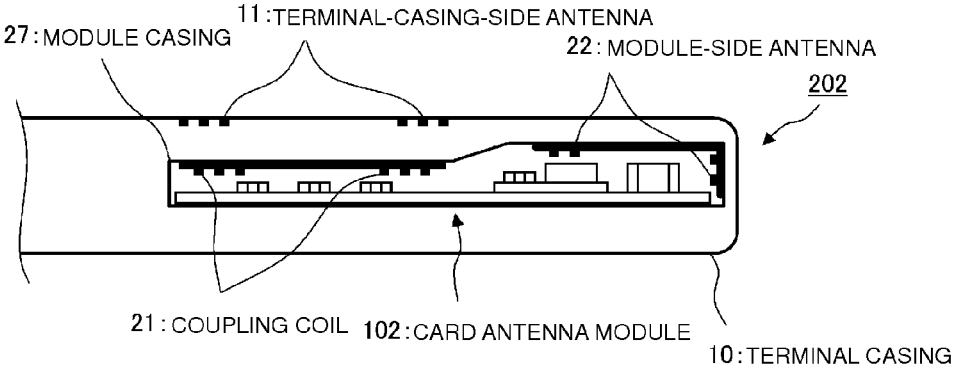
FIG. 4B and FIG. 4C are diagrams illustrating an internal structure of a communication terminal 202 in a state in which the card antenna module 102 according to the second preferred embodiment is loaded therein.
Figure 4C:
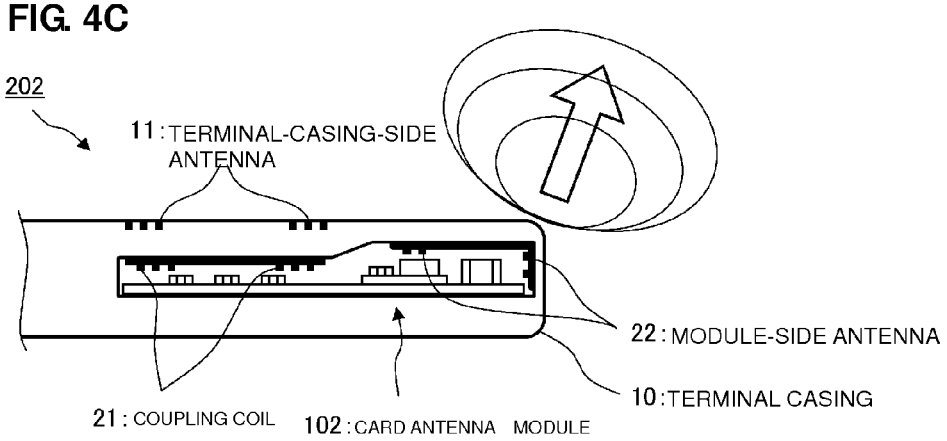

FIG. 4A is a diagram illustrating an internal structure of a card antenna module 102 according to a second preferred embodiment of the present invention, and FIG. 4B and FIG. 4C are diagrams illustrating an internal structure of a communication terminal 202 in a state where the card antenna module 102 according to the second preferred embodiment is loaded therein.

In order to reduce coupling between the terminal-casing-side antenna 11 and the module-side antenna 22, the degree of coupling between the terminal-casing-side antenna 11 and the coupling coil 21 is caused to be higher than the degree of coupling between the terminal-casing-side antenna 11 and the module-side antenna 22. The second preferred embodiment describes an example for realizing this.

In the second preferred embodiment, as illustrated in FIG. 4A, a printed wiring board 26 on which various circuit components 23 are mounted is disposed in a bottom surface portion inside a module casing 27. Also, the coupling coil 21 including a coil pattern is provided on a sheet substrate 24. The sheet substrate 24 is disposed in an upper surface portion inside the module casing 27.

As illustrated in FIG. 4B, in a state where the card antenna module 102 is inserted into the terminal casing 10, the coupling coil 21 is disposed so as to face the terminal-casing-side antenna 11 such that the winding axis of the terminal-casing-side antenna 11 and the winding axis of the coupling coil 21 match or substantially overlap each other. The module-side antenna 22 is located on an upper-end side of the terminal casing 10.

This structure enables the degree of coupling between the terminal-casing-side antenna 11 and the coupling coil 21 to be sufficiently higher than the degree of coupling between the terminal-casing-side antenna 11 and the module-side antenna 22.

In the second preferred embodiment, the module-side antenna 22 including a coil pattern is provided on a flexible sheet substrate 25. The sheet substrate 25 is disposed in a bent state in an inner upper-surface portion and an inner side-surface portion of the module casing 27.

Thus, the terminal-casing-side antenna 11 does not hinder an effect of the module-side antenna 22, and the module-side antenna 22 has directivity illustrated in FIG. 4C (a characteristic of high gain in the direction indicated by the arrow in the figure).

In this way, when a magnetic or metallic flat plate (a printed wiring board in the second preferred embodiment) is provided in the card antenna module 102 and when the card antenna module 102 is loaded into the terminal casing 10, coupling between the terminal-casing-side antenna 11 and the module-side antenna 22 does not occur, as will be described below. Thus, for example, it is not necessary to cover at least three surfaces of the terminal-casing-side antenna 11 (two opening surfaces of the terminal-casing-side antenna 11 and a surface on the module-side antenna 22 side connected thereto) with ferrite or a metallic plate of a large area. Accordingly, the card antenna module 102 which is compact and thin can be realized.

In the communication terminal 202 according to this preferred embodiment, when the resonance frequency of the terminal-casing-side antenna 11 preferably is about 13.56 MHz, for example, if the resonance frequency of the coupling coil 21 is set to be substantially equivalent to or slightly lower than the resonance frequency of the terminal-casing-side antenna 11, for example, about 13.45 MHz, the terminal-casing-side antenna 11 and the coupling coil 21 are coupled with each other via a magnetic field, that is, via mutual inductance, when the terminal-casing-side antenna 11 and the coupling coil 21 become close to each other. As a result, the resonance frequency of an element which is generated through coupling between the terminal-casing-side antenna 11 and the coupling coil 21 via a magnetic field ("coupling element") shifts to a low-frequency side at the vicinity of about 12 MHz, for example. Thus, even if the resonance frequency of the terminal-casing-side antenna 11 is close to the resonance frequency of the module-side antenna 22, the shifted resonance frequency is greatly different from the resonance frequency of the module-side antenna 22 (for example, about 13.65 MHz), and thus coupling between the terminal-casing-side antenna 11 and the module-side antenna 22 can be sufficiently reduced and prevented.

Also, for example, the resonance frequency of the module-side antenna 22 may be designed to be an initially low value of about 10 MHz, and the module-side antenna 22, the coupling coil 21, and the terminal-casing-side antenna 11 may be caused to couple with one another via an electromagnetic field, thereby shifting the resonance frequency of an element generated through the coupling (coupling element) to about 13.56 MHz, for example. Accordingly, the card antenna module 102 may be allowed to operate only when being loaded into the terminal casing 10.

Particularly, the resonance frequency of an element constituted by the terminal-casing-side antenna 11 and the coupling coil 21 ("coupling element") is low viewed from the module-side antenna 22, and thus the coupling element functions as just a metallic plate from an equivalent viewpoint. If the "coupling element" is disposed at a position enabling the "coupling element" and the module-side antenna 22 to be coupled with each other, that is, if the coupling coil 21 and the module-side antenna 22 are close to each other, the "coupling element" functions as a booster antenna of the module-side antenna 22, and is capable of increasing the communication distance of the module-side antenna 22.

Third Preferred Embodiment

The specific configurations of the communication terminal and the card antenna module according to the present invention are not limited to those according to the first and second preferred embodiments.

Figure 5:
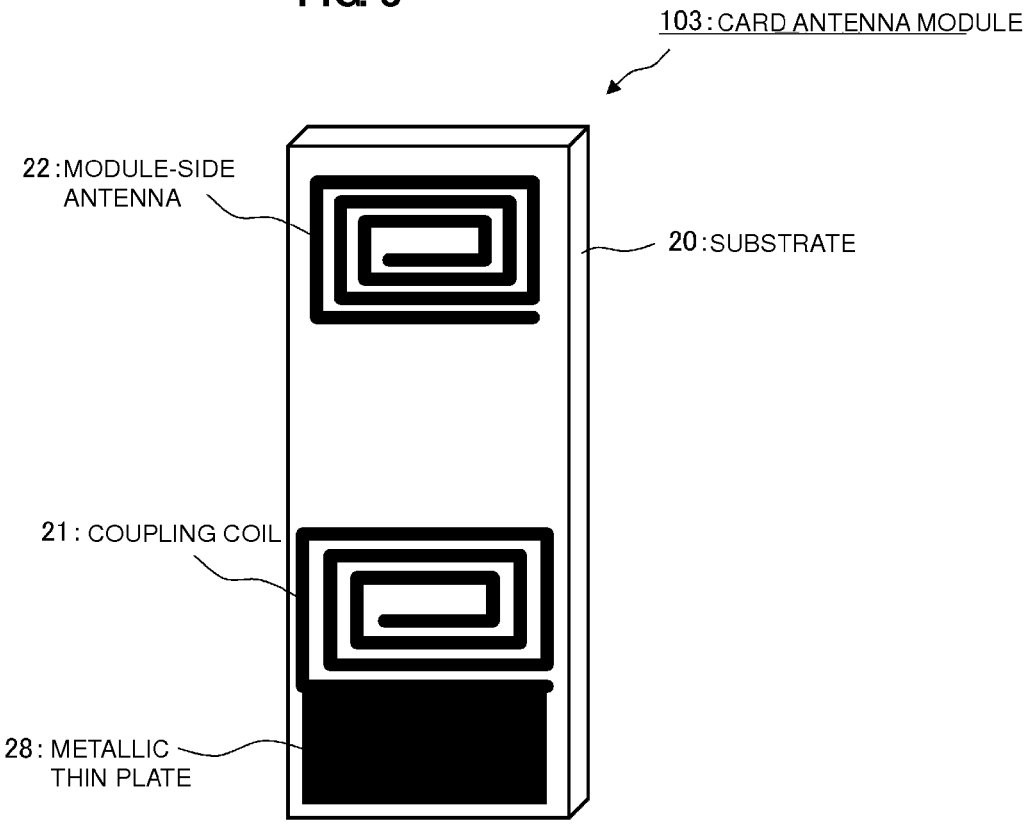
FIG. 5 is a perspective view of a card antenna module 103 according to a third preferred embodiment of the present invention.

FIG. 5 is a perspective view of a card antenna module 103 according to a third preferred embodiment of the present invention. As in this example, the module-side antenna 22 in the card antenna module 103 may be provided on one of principal surfaces or the other principal surface of the substrate 20. Also, a metallic thin plate 28 may be connected to the coupling coil 21. When the coupling coil 21 with the metallic thin plate 28 is used as a booster antenna of the module-side antenna 22, the radiation gain thereof can be increased.

Fourth Preferred Embodiment

Figure 6:
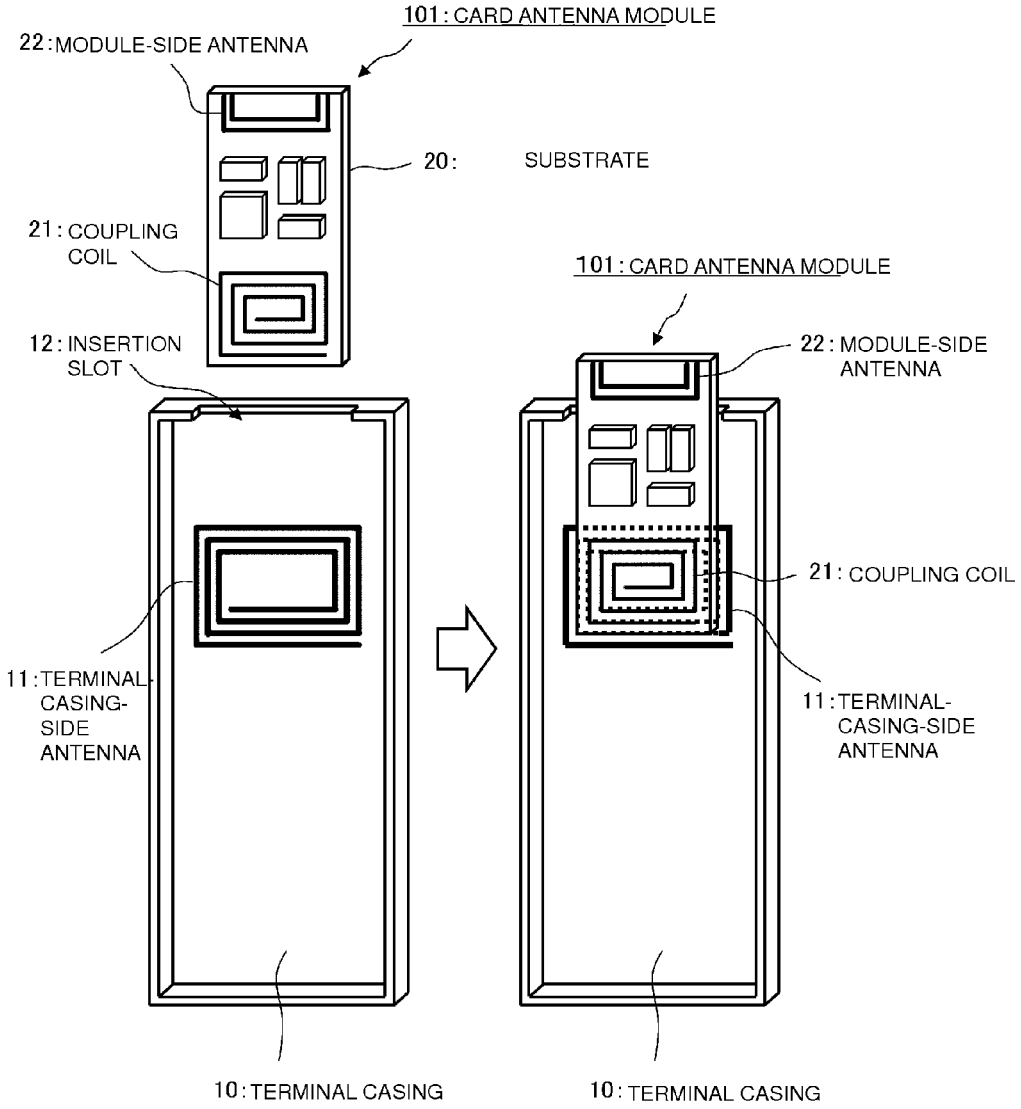
FIG. 6 is a perspective view illustrating a state where the card antenna module 101 is inserted into a communication terminal according to a fourth preferred embodiment of the present invention.

FIG. 6 is a perspective view illustrating a state where the card antenna module 101 is inserted into a communication terminal according to a fourth preferred embodiment of the present invention. FIG. 6 illustrates only a main portion necessary for description, with a front-surface side portion of the terminal casing 10 being removed.

The communication terminal according to the present invention is not limited to a usage form in which the card antenna module is completely loaded into the terminal casing. For example, as illustrated in FIG. 6, the communication terminal may be used in a state where the entire region or a limited portion of the region of the module-side antenna 22 is protruded from the terminal casing 10. The module-side antenna 22 becomes insusceptible to another metallic object, such as the terminal-casing-side antenna 11, and thus the radiation characteristic further increases.

Fifth Preferred Embodiment

Figure 7:
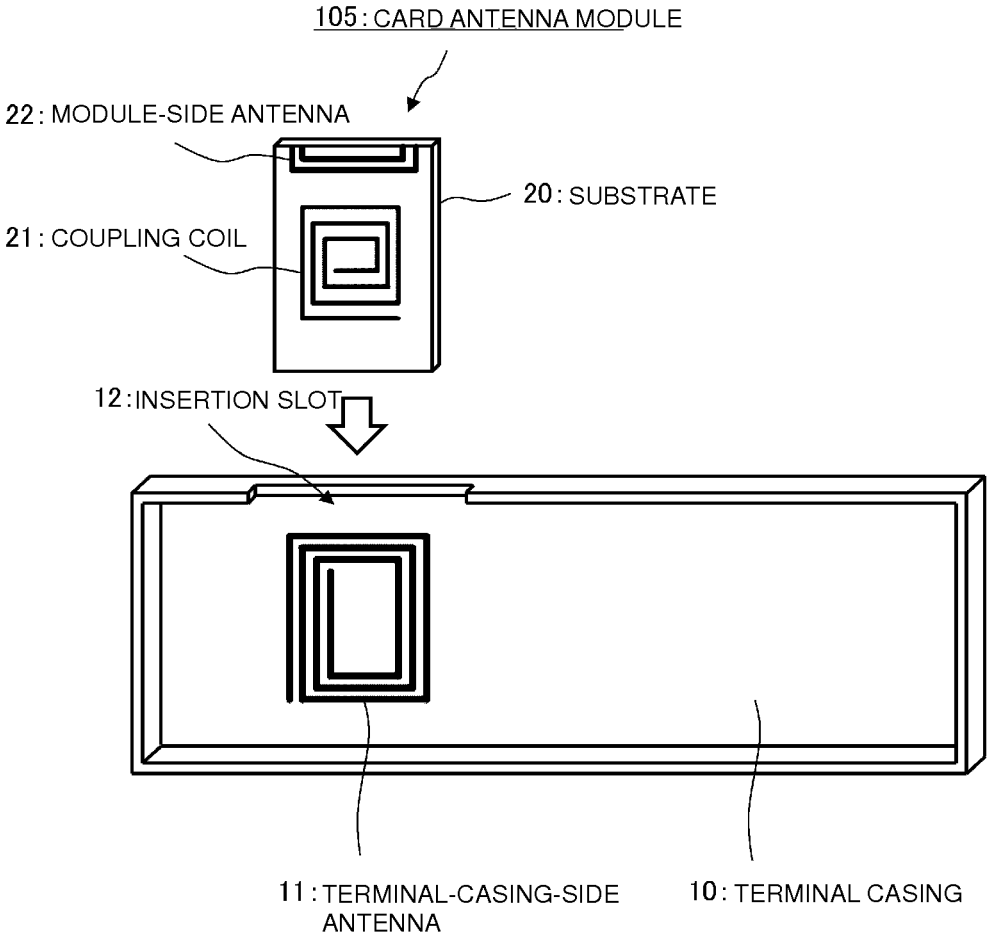
FIG. 7 is a perspective view illustrating a state where a card antenna module 105 is inserted into a communication terminal according to a fifth preferred embodiment of the present invention.

FIG. 7 is a perspective view illustrating a state where a card antenna module 105 is inserted into a communication terminal according to a fifth preferred embodiment of the present invention. FIG. 7 illustrates only a main portion necessary for description, with a front-surface side portion of the terminal casing 10 being removed.

The communication terminal according to a preferred embodiment of the present invention may have a form in which, as illustrated in FIG. 7, for example, the card antenna module 105 is configured as a module of an SIM card (Subscriber Identity Module Card) type and is loaded into a mobile terminal through an insertion slot provided on a side surface of the terminal casing.

Other Preferred Embodiments

A terminal-casing-side antenna and a coupling coil are coupled with each other mainly via a magnetic field if the terminal-casing-side antenna is an HF-band antenna, but may be coupled with each other via an electromagnetic field if the terminal-casing-side antenna is an antenna for a UHF band or SHF band. That is, a terminal-casing-side antenna in a communication terminal and a module-side antenna in a card antenna module are not limited to an antenna for an HF band, but may be an antenna for another frequency band, such as a UHF band or SHF band.

The communication terminal according to various preferred embodiments of the present invention includes a card antenna module that is used for, for example, an RFID system, and is useful as an article management system or the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A communication terminal comprising:

a terminal casing including a terminal-casing-side antenna; and a card antenna module loaded into the terminal casing; wherein the card antenna module includes a coupling resonator which is disposed at a position close enough to the terminal-casing-side antenna to be coupled with the terminal-casing-side antenna, and a module-side antenna which is provided at a distance from the terminal-casing-side antenna that is greater than a distance between the terminal-casing side antenna and the coupling resonator.

2. The communication terminal according to claim 1, wherein the coupling resonator includes a coil pattern, and the terminal-casing-side antenna and the coil pattern are coupled with each other via a magnetic field or an electromagnetic field.

3. The communication terminal according to claim 1, wherein the coupling resonator has a resonance frequency which is equivalent to a resonance frequency of the terminal-casing-side antenna.

4. The communication terminal according to claim 1, wherein the module-side antenna has a resonance frequency which is equivalent to the resonance frequency of the terminal-casing-side antenna.

5. The communication terminal according to claim 1, wherein the module-side antenna and the coupling resonator are disposed close enough to each other so as to be coupled with each other via a magnetic field or an electromagnetic field.

6. The communication terminal according to claim 1, wherein the coupling resonator is electrically independent of another circuit or is connected to a ground.

7. The communication terminal according to claim 1, wherein the module-side antenna is continuously arranged on a principal surface and a side surface of the card antenna module.

8. The communication terminal according to claim 1, wherein a degree of coupling between the terminal-casing-side antenna and the coupling resonator is higher than a degree of coupling between the terminal-casing-side antenna and the module-side antenna.

9. The communication terminal according to claim 1, wherein the module-side antenna is located on a principal surface of a substrate of the card antenna module, and a metallic plate is connected to the coupling resonator to define a booster antenna.

10. The communication terminal according to claim 1, wherein the terminal-casing-side antenna and the module-side antenna are antennas for one of an HF band, a UHF band, and a SHF band.

11. A card antenna module loaded into a terminal casing of a communication terminal including a terminal-casing-side antenna, the card antenna module comprising:

a coupling resonator which is disposed at a position close enough to the terminal-casing-side antenna to be coupled with the terminal-casing-side antenna; and a module-side antenna which is provided at a distance from the terminal-casing-side antenna that is greater than a distance between the terminal-casing side antenna and the coupling resonator.

12. The card antenna module according to claim 11, wherein the card antenna module is loaded only partially into the terminal casing of the communication terminal so as to protrude partially from the terminal casing.

13. The card antenna module according to claim 11, wherein the card antenna module is loaded completely into the terminal casing of the communication terminal.

14. The card antenna module according to claim 11, wherein the card antenna module is a module of a Subscriber Identity Module card.

15. The card antenna module according to claim 11, wherein the card antenna module is loaded only partially into the terminal casing of the communication terminal.

16. The card antenna module according to claim 11, wherein the module-side antenna and the coupling resonator are disposed close enough to each other so as to be coupled with each other via a magnetic field or an electromagnetic field.

17. The card antenna module according to claim 11, wherein a degree of coupling between the terminal-casing-side antenna and the coupling resonator is higher than a degree of coupling between the terminal-casing-side antenna and the module-side antenna.

18. The card antenna module according to claim 11, wherein the terminal-casing-side antenna and the module-side antenna are antennas for one of an HF band, a UHF band, and a SHF band.

19. An RFID system comprising the communication terminal according to claim 1.

20. An RFID system comprising the card antenna module according to claim 11.

* * * * *